United States Patent [19]

Russell

[11] Patent Number: 4,913,502

[45] Date of Patent: Apr. 3, 1990

[54] WORK STATION

[75] Inventor: Edwin R. Russell, Cottesloe, Australia

[73] Assignee: Ergonomic Designs Ltd., Cottesloe, Australia

[21] Appl. No.: 213,519

[22] Filed: Jun. 29, 1988

Related U.S. Application Data

[63] Continuation of Ser. No. 852,963, filed as PCT AU85/00184 on Aug. 2, 1985, published as WO86/01086 on Feb. 27, 1986, abandoned.

[30] Foreign Application Priority Data

Aug. 3, 1984 [AU] Australia ..... PG6419

[51] Int. Cl.[4] ..... A47B 41/06

[52] U.S. Cl. ..... 312/233; 312/316; 312/309; 108/33; 108/38

[58] Field of Search ..... 312/22, 23, 138 R, 138 A, 312/231, 233, 273, 274, 281, 315, 316, 322, 323, 325, 309, 311, 208; 108/38, 40, 33, 6; 248/461, 462; 211/151; 217/57, 59, 60 E, 62

[56] References Cited

U.S. PATENT DOCUMENTS

| | | | |
|---|---|---|---|
| 27,821 | 4/1860 | Pretsch | 312/233 |
| 215,313 | 12/1881 | Stein | 312/315 |
| 510,705 | 12/1893 | Pooley | 312/316 |
| 663,179 | 12/1900 | Martine | 312/233 |
| 1,724,408 | 8/1929 | Miller | 312/274 |
| 1,870,553 | 8/1922 | Bullen | 312/233 |
| 2,712,484 | 7/1955 | Adolphson | 108/38 |
| 2,820,686 | 1/1958 | Snyder | 312/232 |

FOREIGN PATENT DOCUMENTS

| | | | |
|---|---|---|---|
| 0403287 | of 1909 | Fed. Rep. of Germany | 312/273 |
| 0866594 | 4/1961 | United Kingdom | 312/273 |

*Primary Examiner*—Kenneth J. Dorner
*Assistant Examiner*—Gerald Anderson
*Attorney, Agent, or Firm*—Harness, Dickey & Pierce

[57] ABSTRACT

A work station comprising a cabinet (11) normally storing a work surface (18) which can be slid forward as shown. The flap (15) normally covers the front face of the cabinet but can pivot about an intermediate transverse axis thereof, to allow access to the cabinet interior. In various alternatives the flap is pivoted to the cabinet sides or to the work surface either directly or via support arms. In use, the work station may be used to accommodate a personal computer whereby the surface (18) supports a keyboard, the top (14) of the cabinet a VDU, the interior of the cabinet accommodates a disc drive, etc. while the pivoted flap serves as a support for paperwork. A transparent support may be attached to flap (15). It can be flexed or bent outwardly about integral hinge portions to allow insertion of paperwork between the support and the flap.

16 Claims, 6 Drawing Sheets

Figure 2A:
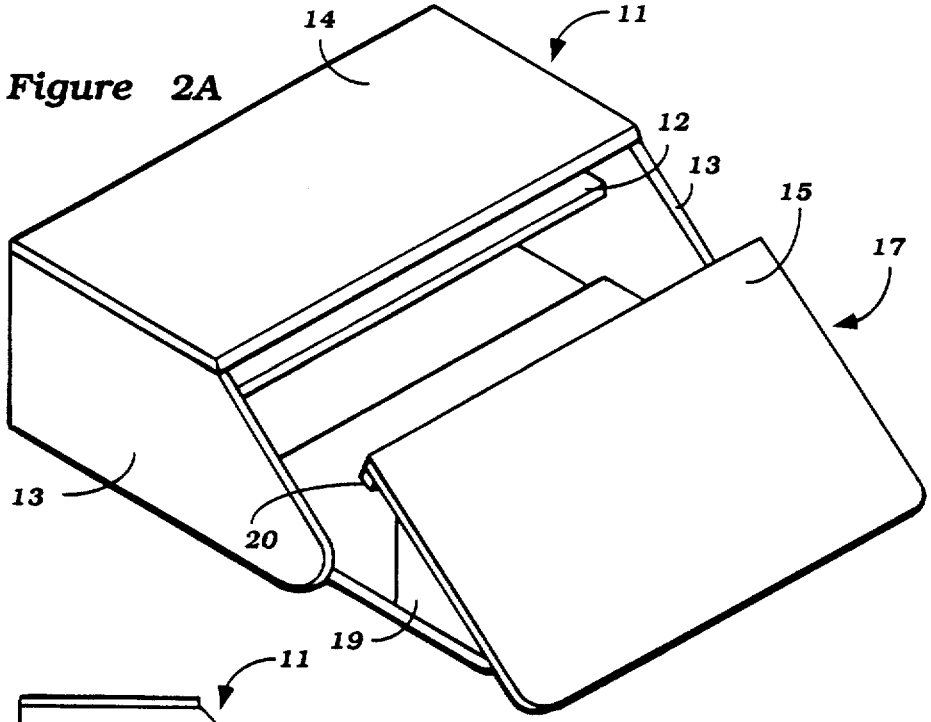

Figure 1A
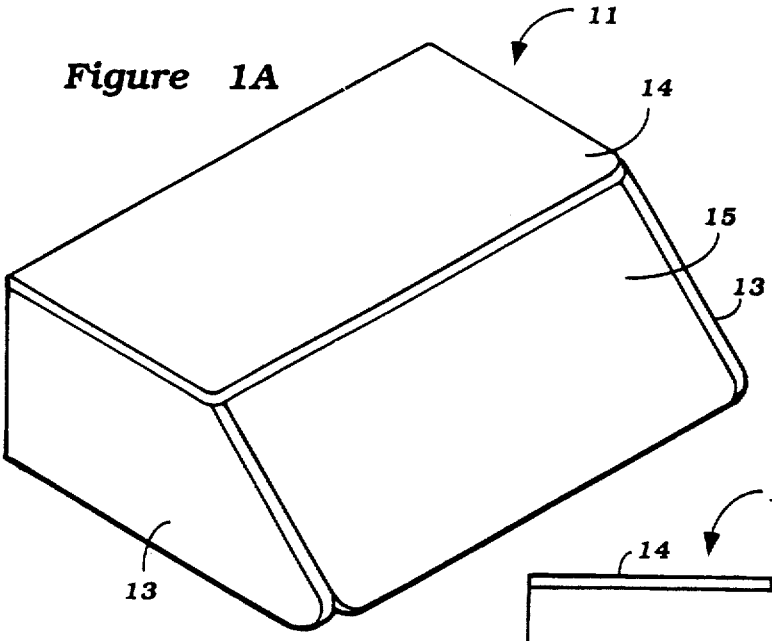
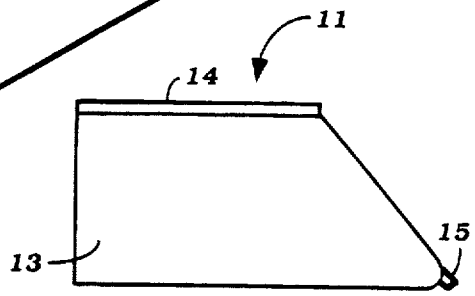
Figure 1B
Figure 1C
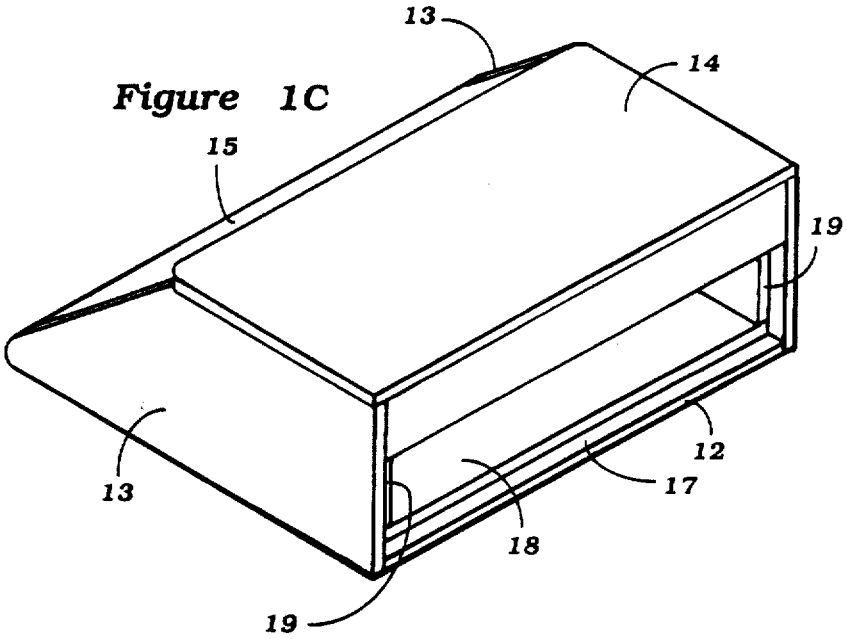

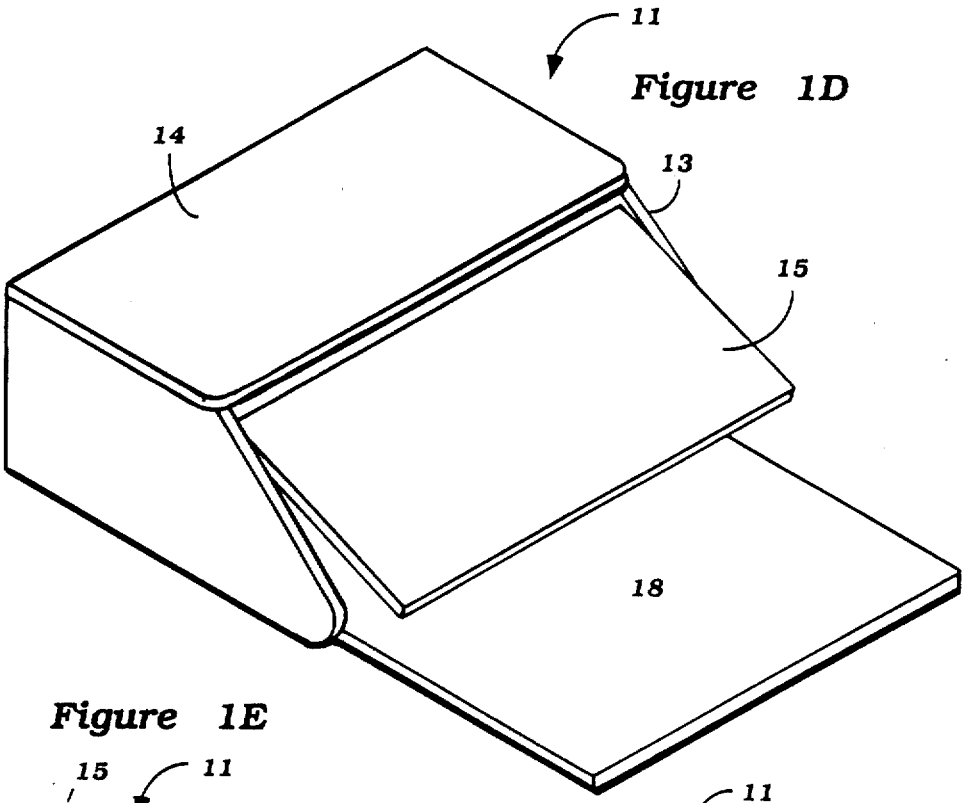
Figure 1D
Figure 1E
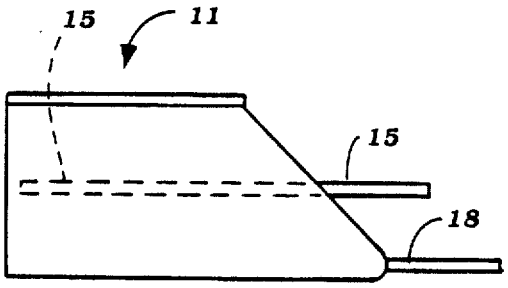
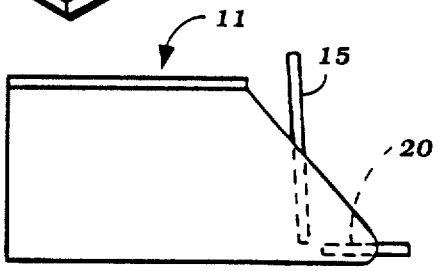
Figure 1G
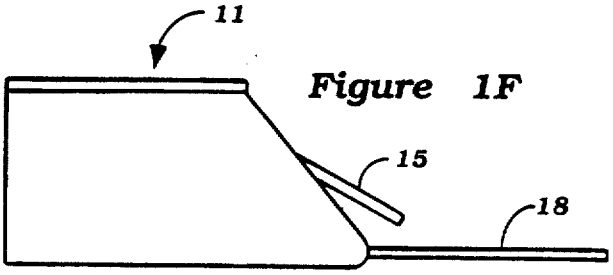
Figure 1F

Figure 8A
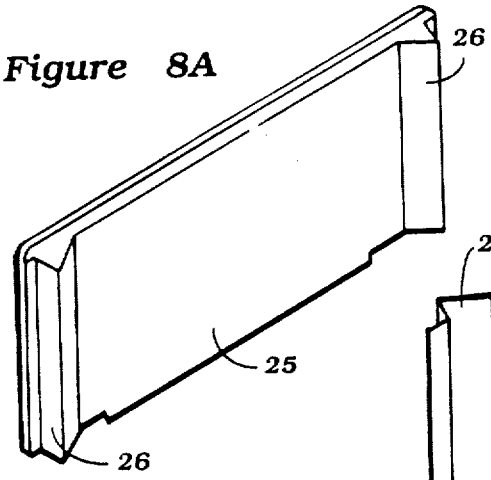
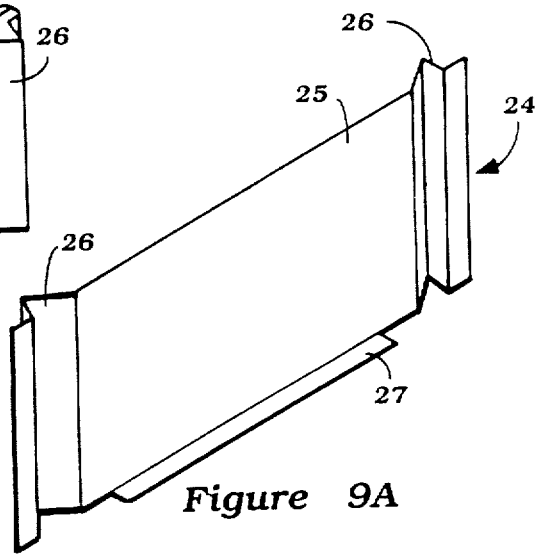
Figure 9A
Figure 8B
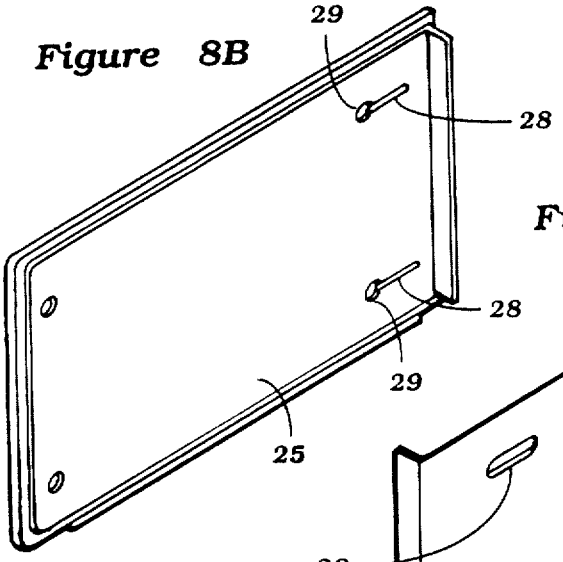
Figure 9B
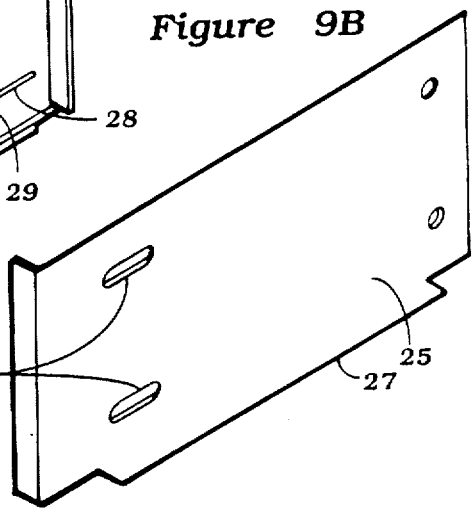

WORK STATION

This is a continuation of patent application Ser. No. 852,963, filed as PCT AU 85/00184 on Aug. 2, 1985, published as WO86/01086 on Feb. 27, 1986, abandoned.

This invention relates to a work station and in particular a work station having a work area and a storage area. With the advent of the home and personal computer which usually comprise separable components consisting of a keyboard, a visual display unit and data input means, such as a disc drive or cassette tape player, the need has developed to store such units whereby they may be readily used from time to time and safely stored between usage.

It is an object of this invention to provide a work station which provides means for storage of components such as those used in relation to computers but which render such components readily accessible when required. In addition the invention may be used in association with video cassette recorders, audio Hi Fi systems, electronic key boards, typewriters, calculators, accounting machines and the like items.

In one form the invention resides in a storage and work station comprising a cabinet having an open front face, a work surface slidably mounted to said cabinet to be slidable outwardly from said open face between a first position at which the work surface is accommodated within the cabinet and a second position at which said work surface extends outwardly from the open face, a flap mounted for movement between a first stored position overlying the open face and a second position at which said closure flap is located to provide a copy support surface behind the work surface when the work surface is in its second position.

According to a preferred feature the flap closes said open face when in its first position.

According to a preferred feature of the previous feature the flap closes the open face in its first position when the work surface is in its first position.

According to a preferred feature of the invention when said flap is in its second position it is capable of lying substantially horizontal or inclined downwardly towards the work surface to provide access to the interior of the cabinet above the rear edge of the flap.

According to a further preferred feature of the invention when said flap is in its second position it is also capable of being located substantially vertically between at least the outer portion of the work surface and cabinet.

According to a preferred feature of the invention said cabinet has a substantially planar upper support surface.

According to a further preferred feature of the invention an intermediate shelf is located within the cabinet to form a rearward extension of the flap when in the inclined or horizontal second position.

According to a further preferred feature of the invention said flap is pivotally supported from the supports located to each side of the work surface for pivotal movement about an intermediate transverse axis of the flap.

According to a further preferred feature of the invention said flap is pivotally supported at either side for pivotal movement relative to the cabinet about an intermediate transverse axis of the flap.

In another form the invention resides in a work station copy support comprising a substantially planar transparent resiliently flexible sheet fixed at its sides to a planar support and adapted to be capable of being flexed outwardly between its sides.

According to a preferred form of the previous form of the invention the sheet is formed with a portion of convoluted configuration towards at least one side which is capable of being flexed to facilitate said outward flexing.

According to another preferred form of the previous form of the invention wherein the fixing to the planar support is effected through slot shaped openings in said sheet being engaged by a bolt, screw, stud or like means to facilitate said outward flexing.

The invention will be more fully understood in the light of the following description of several specific embodiments.

Figure 7A:
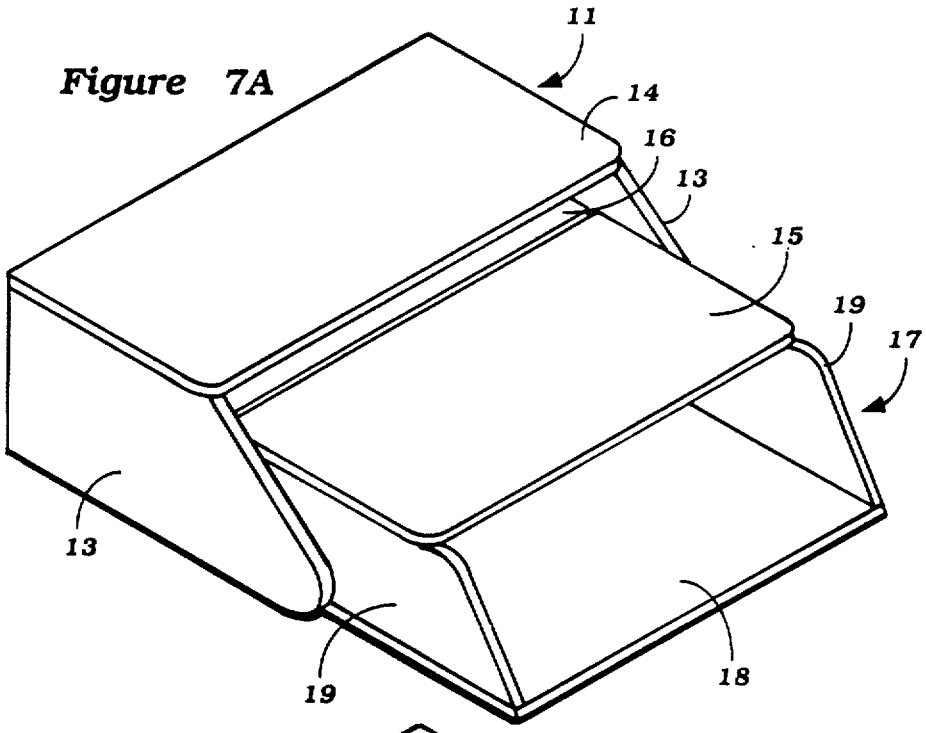
Figure 7B:
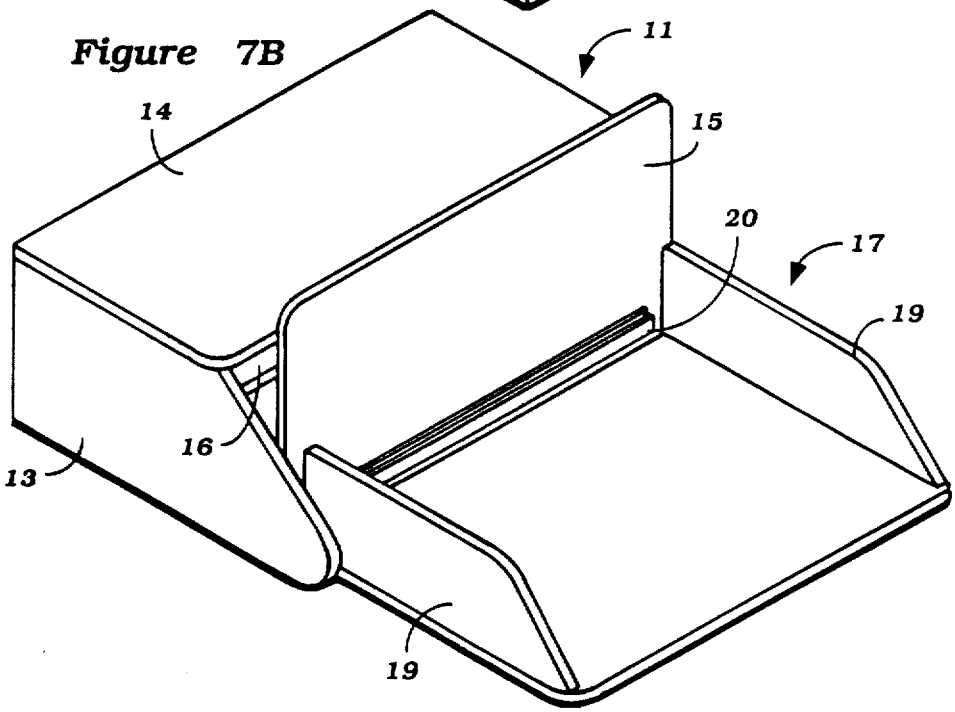

FIGS. 1*a, b* and *c* are a front isometric view, a side elevational view and a rear isometric view respectively of a work station according to the first embodiment in its closed condition;

FIG. 1*d* is a front isometric view of the first embodiment in a first open condition at which said closure flap is inclined downwardly in an open position;

FIGS. 1*e, f* and *g* are side elevations of the first embodiment showing several possible positions of the flap;

FIGS. 2*a, b, c* and *d* are an isometric view and three side elevational views respectively of the second embodiment;

FIGS. 3*a, b* and *c* are three schematic side elevations of the third embodiment;

FIGS. 4*a, b* and *c* are three schematic side elevations of the fourth embodiment;

FIGS. 5*a, b* and *c* are three schematic side elevations of the fifth embodiment;

FIGS. 6*a, b* and *c* are three schematic side elevations of the sixth embodiment;

FIGS. 7*a* and 7*b* are two isometric views of a seventh embodiment;

FIGS. 8*a* and 8*b* are a front and rear isometric view of one form of a copy holder which may be used with each of the embodiments; and FIGS. 9*a* and 9*b* are a front and rear isometric view of a second form of copy holder that may be used with the embodiments.

Each of the embodiments relates to a work station which is intended to house a personal computer or the like such that when the computer is used each of the components are readily accessible and yet when not in use each of the components may be readily stored.

As shown in the drawings the first embodiment comprises a cabinet which may be provided with legs to be self supporting or which may be accommodated on top of a piece of furniture such as a table, chest of drawers, desk top or the like.

The cabinet 11 comprises a base 12, a pair of opposed parallel sides 13 and a substantially horizontal top 14. The rear face of the cabinet is at least partially open to provide for rearward access into the cabinet for interconnection of the various components accommodated within the cabinet by leads and the like. In addition the open rear face of the cabinet allows for ventilation of the interior of the cabinet to prevent overheating of the componetns within the cabinet. If desired the open rear face of the cabinet may be closed by a security grill or like means, other than for leads and the like, to prevent access into the space within the cabinet but to allow airflow through the rear face. The open front face of the cabinet between the front edge of base 12 and the top 11 and each of the side faces 13 is inclined downwardly and is closed by a flap 15 which is pivotally supported from the sides of the cabinet for pivotal movement about an intermediate transverse axis. The flap is movable from the closed position as shown at FIGS. 1*a, b* and *c* to a first open position as shown at FIGS. 1*d, e* and *f* whereby the rear edge of the flap is disposed inwardly and below the front edge of the top 14 of the cabinet 11 and the front edge of the flap is spaced from and disposed forwardly of the base 12 of the cabinet. The flap is also movable to a second open position at which it is substantially horizontal as shown in FIG. 1*e*. The flap is also movable to a third open position at which it may be disposed vertically as shown in FIG. 1*g* wherein the face of the flap which is located on the interior of the cabinet when the flap is in the closed position is disposed forwardly of the cabinet. Suitable friction or lockable pivot hinges (not shown) are provided to pivotally support the flap and to ensure it remains in its various open positions. The interior of the cabinet accommodates an intermediate shelf 16 which is located within the cabinet to form a horizontal extension of the closure flap 15 when said flap is substantially horizontal.

In addition the interior of the cabinet 11 accommodates a drawer-like planar member 17 which is slidably accommodated within the cabinet through the open front face of the cabinet to provide a substantially planar horizontal work surface 18 when extended from within the cabinet. When the drawer-like member 17 is extended from within the cabinet as shown in FIGS. 1*d, e, f* and *g*, the forward area of the work surface 18 and any item such as a keyboard or terminal which may be supported thereon is exposed while the flap 15 provides a copy support surface above and/or behind the keyboard or terminal. When the drawer-like member 17 is fully extended as shown at FIG. 1*g* the flap 15 may be moved to its third open position at which it is substantially vertical and the rear face of the flap 15 which is directed towards the interior of the cabinet 11 when closed, is disposed forwardly of the cabinet. The rear face of the flap 15 may accommodate a copy rest strip 20 located along the edge of the flap which is lowermost when the flap 15 is in its vertical second position of FIG. 3*b* or any other suitable form of copy retention means examples of which are shown at FIGS. 8 and 9.

In use the cabinet of the first embodiment as shown at FIG. 1 may accommodate a personal or micro computer by accommodating the keyboard on the work surface 18 of the drawer-like member 17, a visual display unit on the top 14 of the cabinet 11 and the disc drives or like input units on the intermediate shelf 16. When the computer is not in use the keyboard which is supported on the drawer-like member 17 is accommodated within the cabinet together with the disc drives or like input units and other hardware or software associated with the computer. When it is desired to use the computer, the flap is moved to either its first or second open positions to allow extension of the drawer-like member and to provide access to the keyboard. When the flap is at its second horizontal open position access is available to the input second units on the intermediate shelf 16. In use the front surface of the closure flap 15 serves as a support for copy material which may be required during the operation of the computer such as instruction manuals or input data when the flap is in its first and second open positions. By virtue of the open positions of the closure flap 15 the copy material may be accommodated on an inclined surface or a horizontal surface, or a vertical surface in front of the visual display unit and substantially to the rear of the keyboard.

Similarly the rear face of the flap 15 provides a support for copy material when the flap is in its third open position.

In addition it is envisaged that with the developmnt of low profile or flat screens for visual display units such display units may be accommodated on the rear or front face of the flap.

As a result the first embodiment provides a work station for a computer which can readily accommodate the computer both in use and for secure storage. When the computer is not in use the embodiment is able to protect the components of the computer from dust and if desired the cabinet may be locked to secure components of the computer against theft or misuse.

Figure 2B:
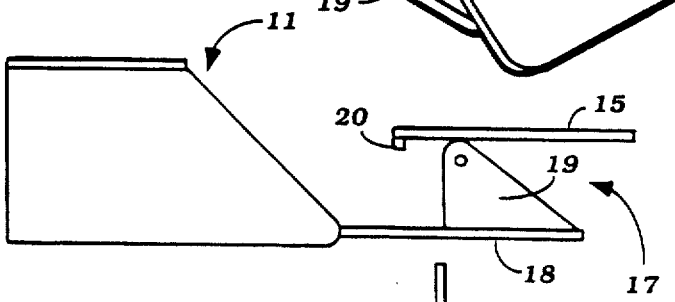
Figure 2C:
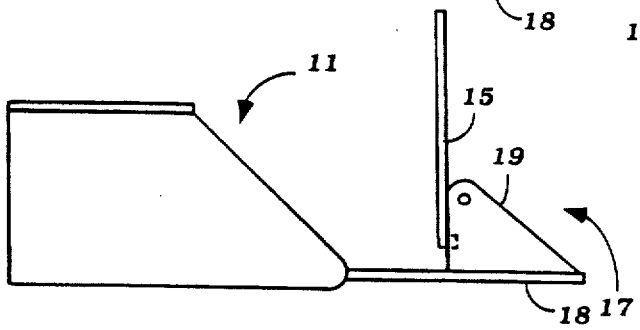
Figure 2D:
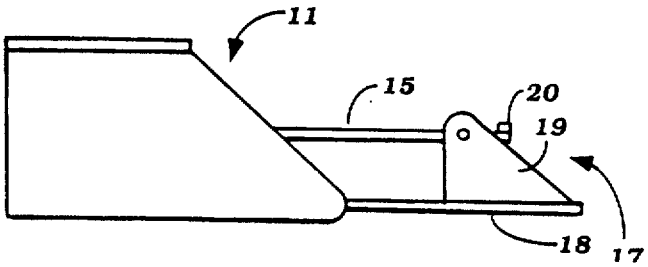

The second embodiment which is shown at FIGS. 2*a, b, c* and *d* is a variation of the first embodiment and as a result common reference numerals are used. In the second embodiment the closure flap 15 is pivotally supported from side panels 19 provided on of the drawer-like member 17. By virtue of each the flap is movable between several positions of which three are shown at FIGS. 2*b, c* and *d* in which the flap may be vertical with the rear face of the flap directed forwardly or horizontal with the front face uppermost or lowermost. In addition the flap may be retained at any inclined position between the positions shown.

The third embodiment of FIGS. 3*a, b* and *c* utilises a closure flap panel 15 which is supported from each side of the cabinet 11 by an arm 21 which is pivotally mounted at one end to the cabinet 11 and at the other end to the flap 15. When the flap is in the closed position the arms 21 lie within the cabinet parallel and adjacent to the rear face of the flap. To open the cabinet the flap is pulled forward away from the open face of the cabinet to allow extension of the drawer-like member 17 and pivotal movement of the flap 15. Suitable friction or lockable pivots or like hinges are provided between the arms and the cabinet and the arms and the flap in order that the flap will remain in each of its inclined positions. In addition the arms may be pivotted to a horizontal position and the flap pivotted to be horizontal over the arms to provide a work surface above the drawer-like member which may accommodate a keyboard or terminal. If desired the flap may have transverse dimensions which permit rotation of the flap between the arms substantially about 360°.

Figures 3, 4, 5, 6:
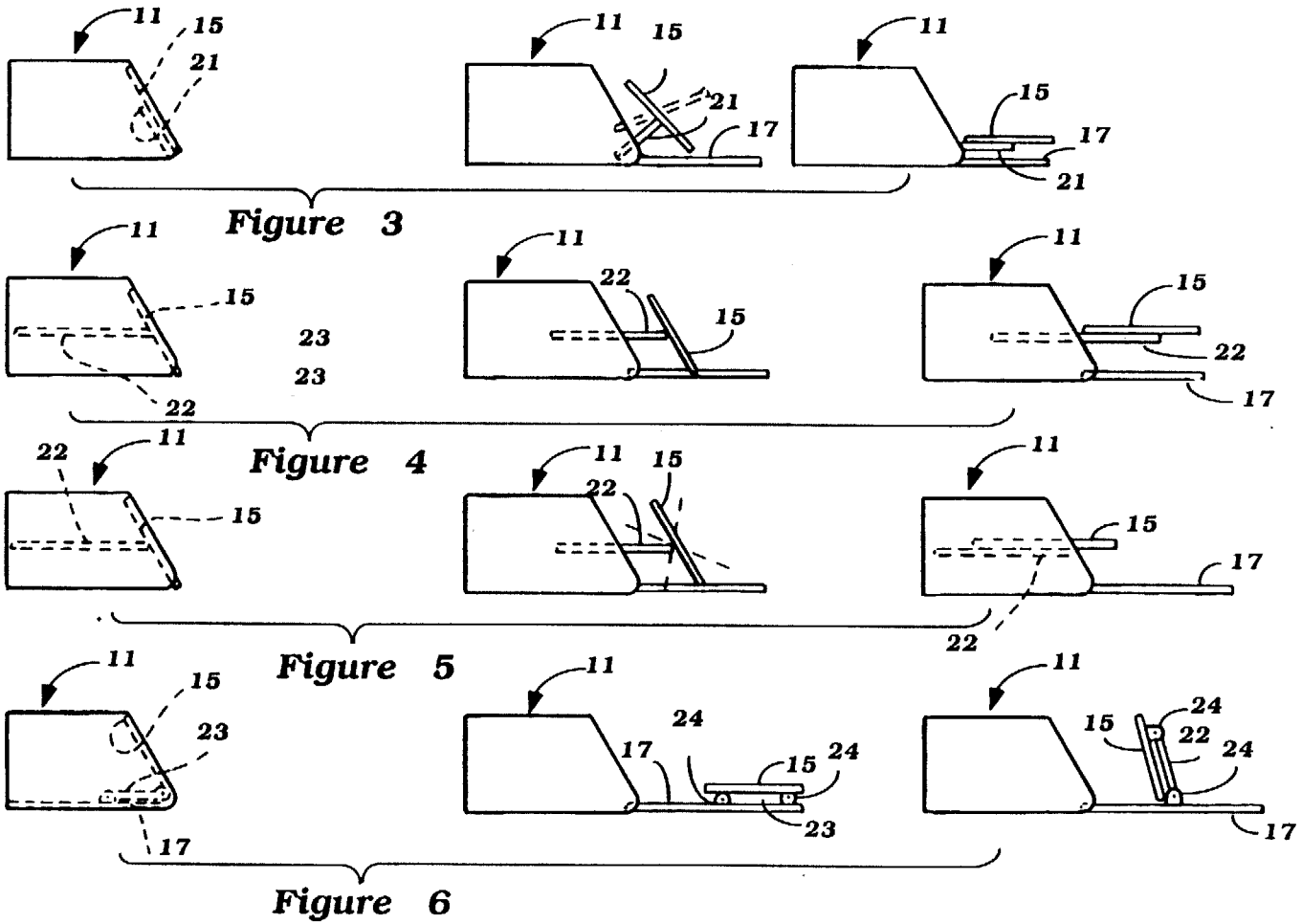

According to a fourth and fifth embodiment as shown at FIGS. 4 and 5 the pivot for the closure flap 15 is supported by a pair of supports 22 which are slidably supported by the sides of the cabinet 11. The supports 22 are slidable independantly of the drawer-like member 17.

In the case of the fourth embodiment of FIGS. 4*a, b* and *c* the flap is dimensioned to overlie the front edges of the sides of the cabinet when in the closed position. In contrast the fifth embodiment as shown at FIGS. 5*a, b* and *c* provides a flap 15 which is dimensioned to be able to pass between the sides of the cabinet and to lie within the supports 22 to be capable of a greater variety of positions above the drawer-like member 17. In addition the flap 15 may be supported within the cabinet as shown at FIG. 5*c* when in the horizontal position or indirect position to provide clear access to the working surface of the drawer-like member by retracting the slidable supports 22.

The sixth embodiment of FIGS. 6*a*, *b* and *c* provides support for the flap 15 by means of arms 23 mounted to each side of the drawer-like member 17 at an intermediate location thereon. The arms are pivotally connected at one end to the upper surface of the drawer-like member 17 and at their other end to their rear face of the flap 15 by hinges 24 having enlarged support bosses. When the flap 15 is in the closed position the arms 23 lie substantially horizontal. On extension of the drawer-like member 17 the flaps may be pivoted to a horizontal position as shown at FIG. 6*b*. The enlarged support bosses of the hinges provide a sufficient spacing between the rear face of the flap 15 and the drawer-like member 17 when the flap is horizontal for a keyboard or terminal to be located therebetween. If desired any suitable form of spacing means may be provided in addition to or as an alternative to the enlarged support bosses.

In addition the arms 23 may be pivoted upwardly and rearwardly from the front edge of the drawer-like member to expose the forward portion of the drawer-like member 17 and the rear face of the flap 17 which may then be used to support copy material.

The seventh embodiment as shown at FIGS. 7*a* and *b* is similar to the first embodiment of FIG. 1 except that the drawer-like member 17 has a pair of side panels 29 having a front edge inclined to conform with the inclination of the front face of the cabinet 11. When the drawer-like member 17 is extended from within the cabinet 11 the flap 15 will ride over the side panels 19 of the drawer-like member as it is withdrawn as shown in FIG. 7*a* whereby the forward area of the work surface 18 is exposed while the flap 15 is substantially horizontal and lies on the upper edges of the side panels 19 of the drawer-like member 17. When the drawer-like member 17 is fully withdrawn as shown at FIG. 7*b* the flap 15 may be moved to its second open position at which it is substantially vertical and the rear face of the open flap 15 which is directed towards the interior of the cabinet 11 when closed, is disposed forwardly of the cabinet. The rear face of the flap 15 accommodates a copy rest 20 located along the edge of the flap which is lowermost when the flap 15 is in the vertical second position shown at FIG. 7*b*.

To support copy material which may take the form of single sheets, folders or books, the copy support surface may be provided with a copy support of the form shown at FIGS. 8*a* and *b*. The copy support comprises a sheet 25 of clear plastics material provided with a bent hinge portion 26 at each end and a support flange 27 along its lower side. The copy support 24 is fixed at its ends to the copy support surface and as a result of the bent hinge portions 26 it can be displaced outwardly from the copy support surface. The support flange 27 serves to prevent the copy material from slipping between the copy support and the copy support surface.

An alternative form of copy support is shown at FIGS. 9*a* and 12*b*. The copy support 24 comprises a sheet 25 of plastics material adapted to be fixed at one end to a copy support surface and having slots 28 at the other end for engagement by screws 29 in the copy support surface to allow for outward flexing of the copy support. The other end also has an outwardly extending flange 30 to provide a surface against which pressure may be applied to flex the copy support 24. The lower side of the copy support 24 also is formed with a rearwardly extending support flange 17.

The copy support is of particular advantage when the copy support surface is substantially upright.

It should be appreciated that in relation to each of the embodiments discussed above the cabinet may be varied to accommodate for improvements in technology. For instance it is envisaged that the rear face of the closure flap which is located to the interior of the cabinet when the cabinet is closed may accommodate a flap screen display which will be exposed when the flap is moved to its second open vertical position. In addition the intermediate shelf of the cabinet may be used to accommodate a visual display unit, if so desired, while the work surface area may accommodate a keyboard which incorporates within itself a visual display screen in the form of a flip up screen pivotted to the rear of the keyboard or any other like display.

Furthermore, the embodiments need not be limited to application with computers since the work surface may be used to accommodate typewriters, organ keyboards, etc. and in such instances the flap may be used for copy material or music respectively. The embodiments may also be used to house audio and/or video systems.

It should be appreciated that the scopy of the present invention need not be limited to the particular scope of the embodiments described above.

The claims defining the invention are as follows:

I claim:

1. A work station comprising a cabinet comprised of a base, a pair of side walls extending upwardly from said base at opposite sides thereof and a top wall supported at the upper ends of said side walls, said cabinet defining a cavity having an open front face extending at an angle to the vertical, a work surface having a vertical height substantially less than the height of said open front face for accommodating a work unit upon said work surface, said work surface being slidably supported by said cabinet and adjacent said base between a first position in which said work surface and the work unit supported therein is accommodated within said cabinet cavity and a second position in which said work surface extends outwardly from said cavity beyond said open face for user access to the work unit, a flap having opposing side faces pivotally supported by said cabinet for pivotal movement relative to said cabinet between a first stored position wherein one of said side faces extends at an angle to the vertical and upwardly and rearwardly from the front edge of said work surface when said work surface is in its first position and overlying and forming a closure for said open face and a second position in which at least one side face of said closure flap extends in an upright manner to provide a copy support surface from a position substantially rearwardly of the front edge of said work surface and adjacent said open face when said work surface is in its second position.

2. A work station as claimed at claim 1 wherein the flap is supported for its movement by the work surface.

3. A work station as claimed in claim 2 wherein the flap is supported by the work surface by a pair of spaced apart arms each having a pivotal connection at one of their ends to said work surface at one side thereof and a pivotal connection at the other ends thereof to said flap.

4. A work station as claimed at claim 3 wherein said flap is pivotal about the other ends of said arms through 180 degrees and wherein said arms are pivotal through 180 degrees relative to said work surface about the one ends.

5. A work station as claimed at claim 1 wherein said flap is supported for pivotal movement relative to the cabinet about an axis transverse to the flap.

6. A work station as claimed at claim 5 wherein the flap is supported from the sides of the cabinet by supports which are slidable outwardly in the direction of the open face of the cabinet.

7. A work station as claimed at claim 6 wherein the flap is able to rotate between said supports about substantially 180°.

8. A work station as claimed at claim 7 wherein the flap is able to rotate between said supports when in its first position.

9. A work station as claimed at claim 6 wherein said flap has transverse dimensions such that it extends laterally beyond the opposed faces of the supports and said supports provide support for the underneath of the flap when in the horizontal position.

10. A work station as claimed at claim 5 wherein said flap is supported from the sides of the cabinet by a pair of arms, each arm being pivotably mounted to a side of the cabinet and pivotally mounted to the flap at a point on the arm spaced from the pivotal mounting to the cabinet.

11. A work station as claimed at claim 10 wherein the flap has transverse dimensions such that it extends laterally beyond the opposed faces of the arms.

12. A work station as claimed at claim 10 wherein the flap is able to rotate between said arms substantially about 180°.

13. A work station as claimed at claim 1 wherein said flap is pivotally supported from the supports located to each side of the work surface for pivotal movement about an axis transverse the flap.

14. A work station as claimed at claim 13 wherein the pivotal mounting for said flaps is located at a position spaced above the work surface.

15. A work station as claimed at claim 13 wherein the supports each comprise an arm pivotally mounted in the work surface and pivotally mounted to the flap at a point on the arm spaced from the pivotal mounting to the work surface.

16. A work station as claimed at claim 15 wherein the pivotal mounting of the arms to the flap are located towards the edge of the flap which is lowermost when the flap is in its first position.

* * * * *